US007743433B1

(12) United States Patent
Grove et al.

(10) Patent No.: US 7,743,433 B1
(45) Date of Patent: Jun. 29, 2010

(54) NECK DAM COLLAR FOR USE WITH CHEMICAL-BIOLOGICAL PROTECTIVE MASKS AND HOODS

(75) Inventors: Corey M. Grove, Red Lion, PA (US); Stephen E. Chase, Jarrettsville, MD (US); Mary P. McCully, Fallston, MD (US); Janelle E. Keberle, Bel Air, MD (US); Leroy H. Stitz, Lutherville, MD (US); Adam D. Seiple, Rosedale, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 258 days.

(21) Appl. No.: 11/401,682

(22) Filed: Apr. 11, 2006

(51) Int. Cl.
*A41D 13/00* (2006.01)

(52) U.S. Cl. ..... 2/465

(58) Field of Classification Search ..... 2/468, 2/455, 410, 2.15, 457
See application file for complete search history.

(56) References Cited

U.S. PATENT DOCUMENTS

| | | | | |
|---|---|---|---|---|
| 3,958,275 | A * | 5/1976 | Morgan et al. | 2/421 |
| 4,015,295 | A * | 4/1977 | Lancaster et al. | 2/2.15 |
| 4,365,351 | A * | 12/1982 | Doerschuk et al. | 2/2.15 |
| 6,854,134 | B2 * | 2/2005 | Cleveland | 2/422 |
| 6,854,459 | B1 * | 2/2005 | Cox | 128/201.23 |

* cited by examiner

*Primary Examiner*—Tejash Patel
(74) *Attorney, Agent, or Firm*—Ulysses John Biffoni

(57) ABSTRACT

A neck dam collar is formed of a substantially vapor-proof material. Resiliently compressible portions of the collar either act as a cushion, a spacer, or both between a neck dam and the wearer's neck. In one embodiment, the collar is a discrete, cylindrical tube of flexible, elastic material. In another embodiment, a protective garment includes the neck dam collar.

22 Claims, 2 Drawing Sheets

NECK DAM COLLAR FOR USE WITH CHEMICAL-BIOLOGICAL PROTECTIVE MASKS AND HOODS

GOVERNMENT INTEREST

The invention described herein may be manufactured, used and licensed by or for the United States Government.

TECHNICAL FIELD

This invention relates to the field of protective apparel, specifically hoods and escape mask systems designed to protect wearers from exposure to chemical and/or biological hazards, and more specifically to neck dams used to create a protective seal between such hoods and masks and the neck of the wearer.

BACKGROUND

Workers in certain hazardous professions, such as emergency rescue workers and military personnel, may in certain circumstances deal with various chemical or biological agents, the inhalation of which, or exposure to which, can be irritating, health-threatening, or even life-threatening. Members of those professions have benefited from the development of hoods and escape mask systems designed to protect the wearer by providing a physical barrier between the wearer and the external environment, and thus preventing chemical or biological threats from contacting the wearer. Such hoods and masks are generally fluid- and air-tight, at least partially envelope the wearer's head, and interface with the wearer's neck. The effectiveness of such hoods and masks in providing complete protection to the wearer depends in part on the ability of one portion of the hood or mask, the neck dam, to form an adequately sound seal about the wearer's neck.

A neck dam is a structure surrounding an opening in a protective hood or mask through which a wearer inserts his or her head into the hood or mask. The neck dam, typically constructed of an elastic or resilient material, is generally smaller in diameter than the head of the wearer, and can be stretched so that the wearer can insert his or her head into the hood. When released, the neck dam contracts and thus becomes positioned proximate to and generally against the wearer's neck, often forming a seal that prevents the entry of gases or agents from the external environment into the hood.

Traditionally, a neck dam relies on the elasticity of the material from which it is constructed to create the seal about the wearer's neck. This construction has certain limitations and drawbacks. For example, the elastic material chosen for use in traditional neck dams may not conform to the physical dimensions of a wearer's neck. In the case of a wearer with a larger diameter neck, the dam may be too tight, possibly leading to shortness of breath and reduced blood flow to the brain due to the pressure of the neck dam on the individual's windpipe and carotid arteries. In the case of a wearer with a smaller diameter neck, the neck dam may be too loose, and thus compromise the quality of the desired seal. When there is not enough sealing pressure to provide an adequate seal around the wearer's neck, movements of the head, such as looking upward or downward, can cause the neck dam to leak, permitting chemical or biological agents to enter the hood or mask.

Accordingly, there is a need for a device and method that may improve the level of protection and/or the level of comfort afforded by neck dams of chemical and biological hoods and escape mask systems.

SUMMARY

According to one aspect of the invention, a collar for a neck dam includes a substantially vapor-proof material with at least a portion adapted to engage a wearer's neck without substantial constriction. The material of the collar is sufficiently compressible to cushion the neck of the wearer against an opposing portion of the neck dam if and when such neck dam pushes or biases against the wearer's neck. The material for the collar may have a sufficient thickness to fill in any gap or gaps that may form between the neck and the neck dam while the user is wearing the neck dam.

According to another aspect of the invention, the material has been configured so as to form a cylindrical passage with two, opposite open ends. In this aspect, the material extends between the open ends, which are sized to be stretched over the wearer's head so as to put the cylindrical passage around the wearer's neck.

According to a still further aspect of the invention, the material comprises a flexible planar fabric having opposite, substantially planar surfaces to define a cylindrical wall. In this aspect of the invention, the thickness of the cylindrical wall corresponds to the thickness of the material. The collar may be constructed with material that is sufficiently flexible to be folded over on itself, which increases the overall thickness of the material extending from the neck to the neck dam. Substantially vapor proof materials include, rubber, synthetic rubber, neoprene, other rubber-like materials, and the like. Silicone rubber may be also be used in certain applications, although it is not considered entirely vapor proof.

According to yet another aspect of the invention, the neck dam collar is used with or is part of an article of apparel.

The details of one or more embodiments of the invention are set forth in the accompanying drawings and the description below. Additional features of the invention will be apparent from the description and drawings and from the claims.

DESCRIPTION OF DRAWINGS

Like reference symbols in the various drawings indicate like elements.

DETAILED DESCRIPTION

Figure 1:
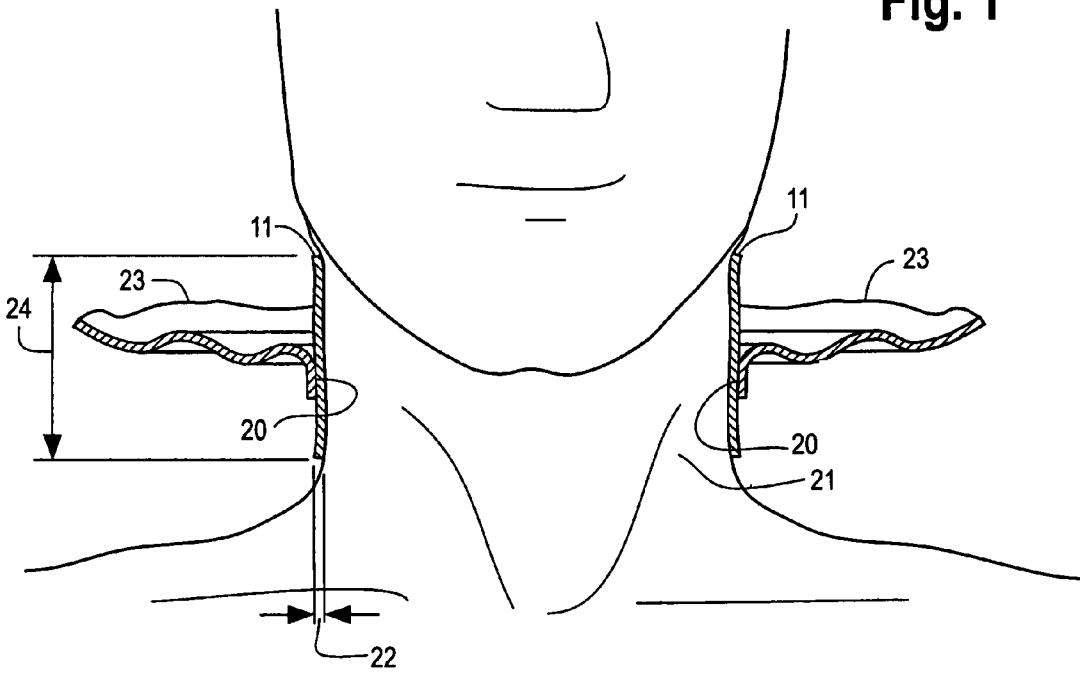
FIG. 1 is a cross-sectional view of one implementation of a neck dam collar positioned between a wearer's neck and the neck dam.
Figure 2:
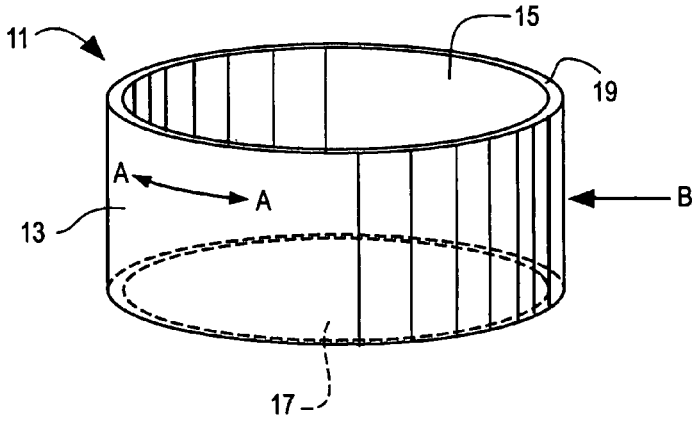
FIG. 2 is a perspective view of the neck dam collar of FIG. 1.

Referring now to FIGS. 1-2, the neck dam collar 11, in one implementation, is adapted to engage or be disposed against a wearer's neck 21, without substantially constricting the wearer's neck. The material of collar 11 is sufficiently compressible to cushion the wearer's neck against any opposing portion 20 of neck dam 23. The material likewise has a thickness 22 sufficient to permit the wearer selectively to position the material between his or her neck and the neck dam and thereby fill in any gap that may form. For example, the thickness 22 may be from between 0.035 inches to 0.065 inches;

however, thickness 22 may also be other thicknesses. It will be appreciated that the functions of cushioning against undue constriction, on the one hand, and filling in actual or potential gaps, on the other hand, will depend on a number of variables, including the relative dimensions or diameters of the wearer's neck and the neck dam, as well as the thickness, resiliency, compressibility, and other structural attributes of the material of collar 11. Thus, the resilient and compressible characteristics permit collar 11 to act as a cushion, a spacer, or both, between the neck.

Neck dam collar 11 is preferably formed into a cylindrical passage 13 having two, opposite open ends 15, 17 and a substantially planar cylindrical wall 19 extending between ends 15, 17. Cylindrical passage 13 may have an inside diameter of about 3.5 inches to about 3.625 inches, however, cylindrical passage 13 may have other inside diameters. Planar cylindrical wall 19 is sufficiently expandable or elastic in the circumferential direction AA (FIG. 2) so that it is capable of being stretched from its static or normal dimensions to have sufficient diameter and dimensions to go over the wearer's head and be placed around the wearer's neck. When released, the material of collar 11 returns to its native shape and dimensions, which are generally smaller in diameter than the wearer's head, but also generally selected to comfortably encircle the wearer's neck 21.

The material of collar 11 is likewise resiliently compressible, at least in the orthogonal or radial direction B (FIG. 2) and the material may also be substantially vapor-proof one, which means that aerosols and vapors cannot substantially penetrate the material. Vapor-proof material also includes air-tight material. In one implementation, the material is rubber, silicone rubber, neoprene, other rubber-like materials, and any composite material using rubber, neoprene, other vapor barrier materials, and the like.

It will be appreciated from the description above that when neck dam collar 11 is worn, it engages the wearer's neck 13 snugly, but comfortably. "Engaging" the wearer's neck means it is disposed against the neck.

Figure 3:
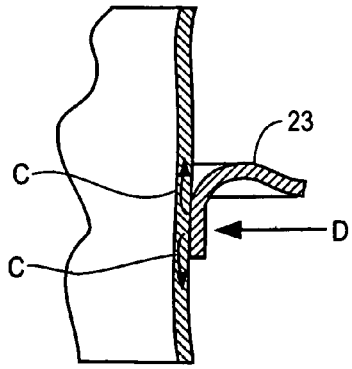
FIG. 3 is a close up, cross-sectional view of the interface of the neck dam collar and the neck dam as shown in FIG. 1.

More particularly, in the case of a wearer with a larger diameter neck, a conventional neck dam may be too tight, possibly leading to shortness of breath and reduced blood flow to the brain due to the pressure of the neck dam being exerted over a relatively small area against the individual's windpipe and carotid arteries. In the case of a wearer with the larger diameter neck, the cushioning characteristics of collar 11 may reduce the discomfort by dispensing or dissipating the orthogonal forces of neck dam 23, as shown by arrows C in FIG. 3. In the case of a wearer with a smaller diameter neck, a conventional neck dam may be too loose and thus compromise the quality of the desired seal. For example, when there is not enough sealing pressure to provide an adequate seal around the wearer's neck, movements of the head, such as looking upward or downward, can cause the neck dam to leak, permitting chemical or biological agents to enter the hood or mask. The resilient characteristics of collar 11, however, fill in any potential gaps or increase assurances that such gaps do not form. It will be appreciated that the gap filing/spaces characteristics and cushioning characteristics are often both in play for any given wearer at the collar.

Figure 4:
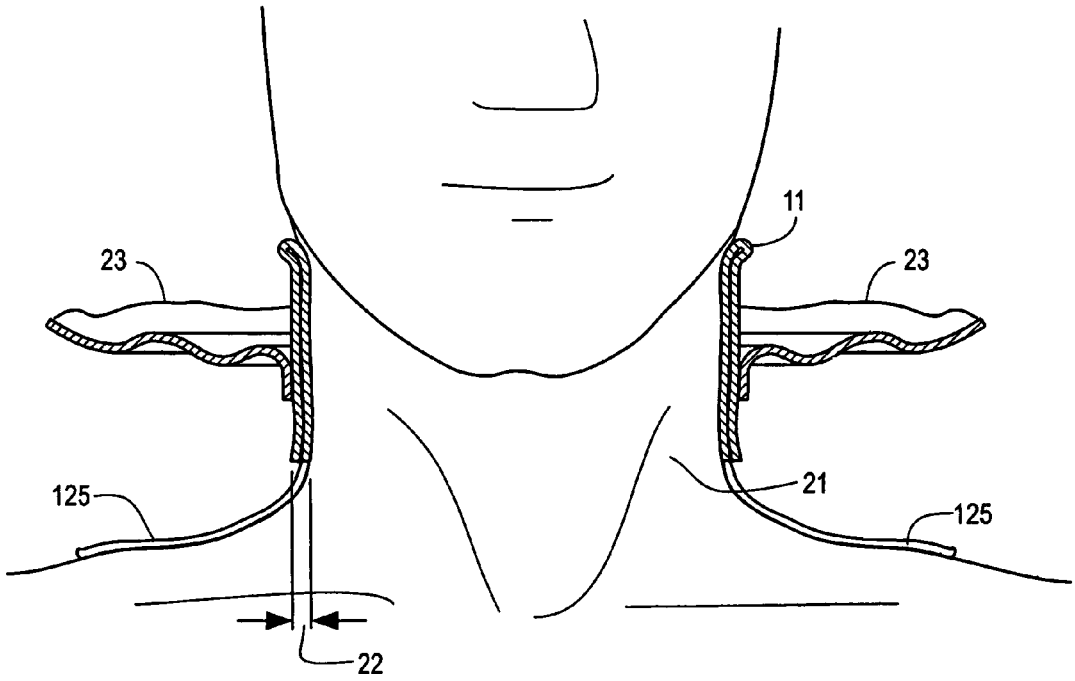
FIG. 4 is a cross-sectional view of an article of apparel, such as a protective suit, including a neck dam collar, and showing the neck dam collar folded over on itself.
Figure 5:
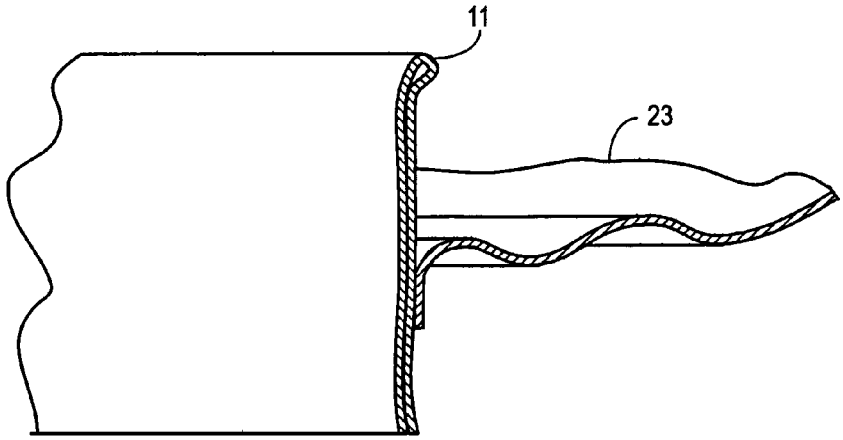
FIG. 5 is a close up, cross-sectional view of the interface of the folded portion of the neck dam collar with the neck dam as shown in FIG. 4.

It may be desirable in some applications to employ collar 11 in a folded configuration, such as shown in FIGS. 4 and 5. The same principles and functions of collar 11 are present, except for the increased thickness 22 and resulting increase in cushioning and/or resiliency. Collar 11 may be folded once, twice, and the like, to accommodate different size necks.

The collar 11 in this embodiment has been secured to a protective suit 125. Collar 11 likewise could be secured to neck dam 23 itself.

Although neck dam collar 11 has been shown in this embodiment as a flexible, planar wall 19, other configurations are possible so long as a portion of collar 11 is disposed snugly but comfortably between the wearer's neck and one or more opposing portions of neck dam 23. Such alternate configurations, like that illustrated in FIGS. 4 and 5, may cushion larger necks against unnecessary constriction, and improve the seal of deck dam 21 against actual or potential gaps or leaks.

Neck dam collar 11 can have a variety of suitable lengths 24 for cylindrical wall 19. Generally, the height 24 is sufficiently long to account for variations in the vertical position of opposing neck dam portions 20 relative to the wearer's neck. The height 24 may be about 4.5 inches; however, alternative heights are contemplated. In other words, numerous geometric variables will dictate the range of vertical positions of opposing neck dam portions 20 and it is preferable, but not required, for collar 11 to remain between the opposing portions 20 and the wearer's neck regardless of such variations in the fit or neck dam geometry.

The material of neck dam collar 11 may be a single-ply rubber material such as silicone rubber, or the like, and it will be appreciated that laminate structures, such as neoprene, are likewise suitable. The functional characteristics of the two layers can be varied relative to each other to enhance the effectiveness of the collar. Thus, for example, the outer layer (not shown) may be selected to have more resilience to better dissipate the forward force of opposing portion 20, whereas the inner layer (not shown) may have more give or cushioning to enhance comfort. The reverse construction may likewise be suitable.

What is claimed is:

1. A neck dam collar to be placed on a wearer's neck when also wearing a chemical-biological protective mask or protective hood having a neck dam, the collar comprising:

a tubular-shaped structure forming a cylindrical passage with two opposite open ends, the neck dam extends outwardly and is positioned generally about a central region of the tubular shaped structure and wherein, said collar comprises a vapor-proof material;

said material is adapted to have at least a portion of the material engage the wearer's neck without substantial constriction;

said material is sufficiently compressible to cushion the wearer's neck against an opposing portion of said neck dam in the event the neck dam biases against the neck so that the neck dam does not unduly constrict the wearer's neck; and said material having a thickness sufficient to permit the wearer selectively to position the material between the wearer's neck and the neck dam to fill in any gap that may form between the neck and the neck dam so that an airtight seal is maintained between the neck dam and the wearer's neck.

2. The collar of claim 1, wherein the material is elastic and is sized and configured to stretch over the wearer's head.

3. The collar of claim 2, wherein the open ends are sized to be stretched over the wearer's head to position the cylindrical passage so that it fits in direct contact around the wearer's neck, with no gap between the collar and the neck of the wearer.

4. The collar of claim 1, wherein the material comprises a flexible, planar fabric having opposite, substantially planar surfaces to define a cylindrical wall, wherein the thickness of the cylindrical wall corresponds to the thickness of the material.

5. The collar of claim 4, wherein the material is sufficiently flexible to be folded over on itself to increase overall thickness of the material extending from the neck to the neck dam.

6. The collar of claim 1, wherein the material is at least one of the materials selected from a group consisting of silicone rubber, rubber, synthetic rubber, and neoprene.

7. An article of protective clothing having a neck dam collar, to be worn by a wearer when also wearing a chemical-biological protective mask or protective hood having a neck dam, the neck dam collar comprising:

a tubular-shaped structure forming a cylindrical passage with two opposite open ends, the neck dam extends outwardly and is positioned generally about a central region of the tubular shaped structure and wherein, said collar comprises a vapor-proof material;

said material is adapted to have at least a portion of the material engage the wearer's neck without substantial constriction;

said material is sufficiently compressible to cushion the wearer's neck against an opposing portion of said neck dam in the event the neck dam biases against the neck so that the neck dam does not unduly constrict the wearer's neck; and said material having a thickness sufficient to permit the wearer selectively to position the material between the wearer's neck and the neck dam to fill in any gap that may form between the neck and the neck dam so that an airtight seal is maintained between the neck dam and the wearer's neck.

8. The article of protective clothing of claim 7, wherein the material comprising the neck dam collar is elastic and is sized and configured to stretch over a wearer's head.

9. The article of protective clothing of claim 8, wherein the open ends are sized to be stretched over the wearer's head to position the cylindrical passage around the wearer's neck.

10. The article of protective clothing of claim 7, wherein the material comprising the neck dam collar comprises a flexible, planar fabric having opposite, substantially planar surfaces to define a cylindrical wall, wherein the thickness of the cylindrical wall corresponds to the thickness of the material.

11. The article of protective clothing of claim 10, wherein the material comprising the neck dam collar is sufficiently flexible to be folded over on itself to increase overall thickness of the material extending from the neck to the neck dam.

12. The article of protective clothing of claim 7, wherein the material comprising the neck dam collar is at least one of the materials selected from a group consisting of silicone rubber, rubber, synthetic rubber, and neoprene.

13. The article of protective clothing of claim 7, wherein the article of protective clothing comprises at least one item selected from the group consisting of a biologically or chemically protective suit, a biologically or chemically protective hood, or an escape mask.

14. A chemically or biologically protective suit, said suit for use with a chemical-biological protective mask or protective hood having a neck dam, said suit comprising:

a neck dam the neck dam extends outwardly and is positioned generally about a central region of a tubular shaped structure collar configured to engage said neck dam, and wherein said collar comprises a vapor proof material wherein the material is adapted to have at least a portion of the material engage a wearer's neck without substantial constriction;

the material is sufficiently compressible to cushion the wearer's neck against an opposing portion of a neck dam in the event the neck dam biases against the neck so that the neck dam does not unduly constrict the wearer's neck; and the material has a thickness sufficient to permit the wearer selectively to position the material between the wearer's neck and the neck dam to fill in any gap that may form while wearing the neck dam between the neck and the neck dam so that an airtight seal is maintained between the neck dam and the wearer's neck.

15. The protective suit of claim 14, wherein the material comprising the neck dam is elastic and is sized and configured to stretch over a wearer's head.

16. The protective suit of claim 14, wherein the material comprising the neck dam collar has been configured to form a cylindrical passage with two, opposite, open ends, and a length of material extending between the open ends, the open ends sized to be stretched over the wearer's head to position the cylindrical passage around the wearer's neck and in direct contact with the wearer's neck.

17. The protective suit of claim 14, wherein the material comprising the neck dam collar comprises a flexible, planar fabric having opposite, substantially planar surfaces to define a cylindrical wall, wherein the thickness of the cylindrical wall corresponds to the thickness of the material.

18. The protective suit of claim 17, wherein the material comprising the neck dam collar is sufficiently flexible to be folded over on itself to increase overall thickness of the material extending from the neck to the neck dam.

19. The protective suit of claim 14, wherein the material comprising the neck dam collar is at least one of the materials selected from a group consisting of silicone rubber, rubber, synthetic rubber, and neoprene.

20. A method of putting on a protective hood or mask in which the hood or mask includes a neck dam for the wearer's neck, the method comprising:

first encircling the wearer's neck with a flexible, resiliently compressible, vapor-proof material having a thickness associated therewith to provide a diameter greater than the wearer's neck, and wherein said material is in direct contact with the wearer's neck; and then engaging the material with the neck dam of the hood or mask.

21. The method of claim 20, further comprising folding the material along the circumference of the material prior to engaging the material with the neck dam.

22. The method of claim 20, further comprising folding the material along the circumference of the material prior to engaging the material with the neck dam, thereby doubling the effective thickness of the material between the wearer's neck and the neck dam.

* * * * *